US007089612B2

(12) United States Patent
Rocher et al.

(10) Patent No.: US 7,089,612 B2
(45) Date of Patent: Aug. 15, 2006

(54) MOTORIZED OPERATING TABLE WITH MULTIPLE SECTIONS

(75) Inventors: Philippe Rocher, Orleans (FR); Jean-Marie l'Hegarat, Olivet (FR)

(73) Assignee: FHSurgical, (FR)

( * ) Notice: Subject to any disclaimer, the term of this patent is extended or adjusted under 35 U.S.C. 154(b) by 537 days.

(21) Appl. No.: 10/615,106

(22) Filed: Jul. 8, 2003

(65) Prior Publication Data

US 2006/0080777 A1 Apr. 20, 2006

Related U.S. Application Data

(63) Continuation of application No. PCT/FR02/00051, filed on Jan. 8, 2002.

(30) Foreign Application Priority Data

Jan. 9, 2001 (FR) ..... 01 00218

(51) Int. Cl.
*A61G 13/08* (2006.01)

(52) U.S. Cl. ..... 5/613; 5/616; 5/600

(58) Field of Classification Search ..... 5/613, 5/616, 617, 618, 611, 11, 600, 940, 607, 608, 5/610

See application file for complete search history.

(56) References Cited

U.S. PATENT DOCUMENTS 3,473,024 A * 10/1969 Feiertag ..... 5/601
3,493,745 A * 2/1970 Brunnett et al. ..... 378/81
3,822,875 A * 7/1974 Schmedemann ..... 5/601
4,325,061 A * 4/1982 Wolar ..... 340/679
4,403,214 A * 9/1983 Wolar ..... 340/540
4,407,030 A * 10/1983 Elliott ..... 5/616
4,463,463 A * 8/1984 Kaneko ..... 5/616
4,534,077 A * 8/1985 Martin ..... 5/424
4,552,403 A * 11/1985 Yindra ..... 297/330
4,578,757 A 3/1986 Stark ..... 703/301
4,628,556 A * 12/1986 Blackman ..... 5/424
4,724,554 A * 2/1988 Kowalski et al. ..... 5/610
4,960,271 A * 10/1990 Sebring ..... 5/608
4,969,170 A * 11/1990 Kikuchi et al. ..... 378/91
4,987,583 A * 1/1991 Travanty et al. ..... 378/91
5,056,365 A * 10/1991 Gray et al. ..... 73/432.1
5,097,495 A * 3/1992 Gray et al. ..... 378/117
5,129,116 A * 7/1992 Borders et al. ..... 5/617
5,156,166 A * 10/1992 Sebring ..... 5/608
5,168,591 A * 12/1992 Hakamiun et al. ..... 5/689
5,220,698 A * 6/1993 Hannant ..... 5/611

(Continued)

FOREIGN PATENT DOCUMENTS

EP 0 787 475 A2 8/1997

(Continued)

*Primary Examiner*—Robert G. Santos
(74) *Attorney, Agent, or Firm*—DLA Piper Rudnick Gray Cary US LLP

(57) ABSTRACT

An operating table including at least three elements which are moveable in relation to each other; at least two actuators, each controlling displacement of two elements in relation to the other; a controller which drives each actuator; a sensor to detect a risk of collision of one of the elements with an obstacle when executing a displacement request of a first actuator; a controller which determines a corrective command order of a second actuator different from the first actuator upon detecting a risk of collision, wherein execution of the corrective command order by the second actuator causes cessation of the detected risk of collision upon subsequent execution of the displacement request of the first actuator; and a display to view the corrective command order.

9 Claims, 8 Drawing Sheets

U.S. PATENT DOCUMENTS 5,317,769 A * 6/1994 Weismiller et al. ..... 5/610
5,386,453 A * 1/1995 Harrawood et al. ..... 378/196
5,428,851 A * 7/1995 Shore et al. ..... 5/87.1
5,485,502 A 1/1996 Hinton et al. ..... 378/117
5,570,770 A * 11/1996 Baaten et al. ..... 192/147
5,883,935 A * 3/1999 Habraken et al. ..... 378/117
6,408,051 B1 * 6/2002 Habraken et al. ..... 378/117
6,430,259 B1 * 8/2002 Meek et al. ..... 378/117
6,462,500 B1 * 10/2002 L'Hegarat et al. ..... 318/649
6,651,279 B1 * 11/2003 Muthuvelan ..... 5/600
6,857,147 B1 * 2/2005 Somasundaram ..... 5/601
6,874,182 B1 * 4/2005 L'Hegarat et al. ..... 5/612
6,927,395 B1 * 8/2005 Koops et al. ..... 250/363.08
2004/0083549 A1 * 5/2004 L'Hegarat et al. ..... 5/621
2004/0172756 A1 * 9/2004 Somasundaram ..... 5/600
2004/0172758 A1 * 9/2004 Alakkat ..... 5/610
2004/0216235 A1 * 11/2004 Rees ..... 5/618

FOREIGN PATENT DOCUMENTS

FR 2 749 503 A1 12/1997

* cited by examiner

MOTORIZED OPERATING TABLE WITH MULTIPLE SECTIONS

RELATED APPLICATION

This is a continuation of International Application No. PCT/FR02/00051, with an international filing date of Jan. 8, 2002, which is based on French Patent Application No. 01/00218, filed Jan. 9, 2001.

FIELD OF THE INVENTION

The present invention pertains to an operating table of the type comprising at least three elements which are mobile in relation to each other, and at least two actuators each controlling the displacement of two elements in relation to the other, the table moreover comprising means for driving each actuator and means for detecting a risk of collision of one of the operating table's mobile elements with an obstacle when executing a displacement request of a first actuator.

BACKGROUND

In modern surgical operating tables each mobile element is controlled by a motorized actuator, especially electrically powered, enabling the surgeon or an operator to effortlessly displace the controlled element.

Because of the multiplication of the mobile elements in relation to each other and thus the multiplication of the possible configurations of the table, numerous risks of collision of the elements with each other can occur. Similarly, the end elements can strike obstacles present in the operating room, especially the floor.

When such a collision occurs or immediately before such an occurrence, the movement of the operating table controlled by the user is interrupted. The stopping of the maneuver is often perceived by the user as a malfunction of the operating table. Moreover, such a stopping is difficult for the user to interpret because he helplessly encounters a request for displacement that he wants to execute but that he can not implement for mechanical reasons that he does not always perceive.

After an involuntary stopping of a maneuver, the user often acts blindly on the other controls available to him but nevertheless is unable to subsequently perform with certainty the maneuver that he initially wanted to implement.

It would therefore be advantageous to provide an operating table that prevents this user predicament when a collision occurs or risks to occur between an element of the table and a neighboring obstacle especially on the floor, or when there is the risk that two of the table's mobile elements might collide with each other.

SUMMARY OF THE INVENTION

This invention is an operating table of the previously mentioned type, characterized in that it comprises means for determining a corrective command of a second actuator different from the first actuator upon detecting a risk of collision, the execution of the corrective command order by the second actuator causing the cessation of the detected risk of collision upon subsequent execution of the displacement request of the first actuator, and means to make available to the user this corrective command order.

BRIEF DESCRIPTION OF THE DRAWINGS

Better comprehension of the invention will be obtained from the description below presented solely as an example and with reference to the attached drawings in which.

DETAILED DESCRIPTION

Figure 1:
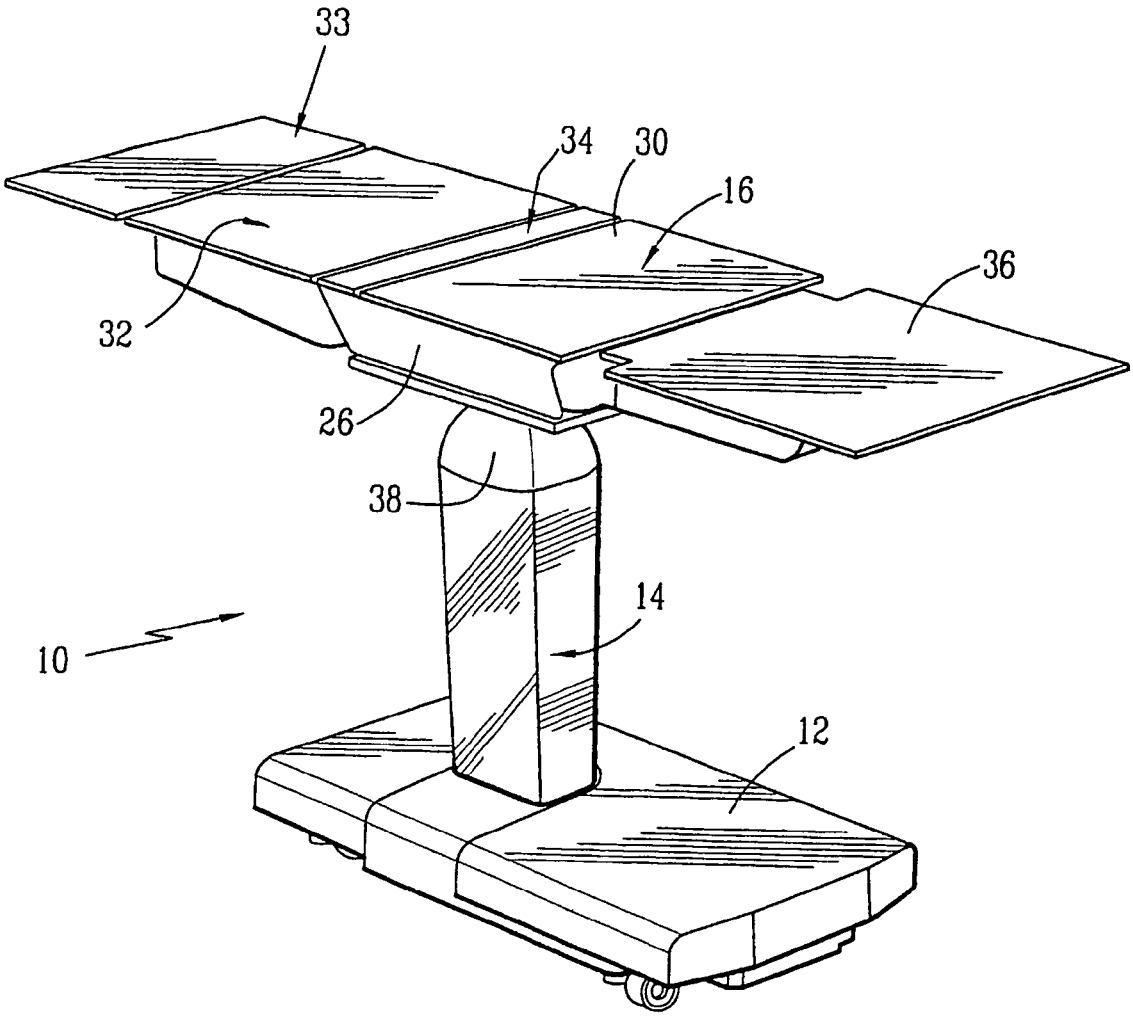
FIG. 1 is a perspective view of an operating table according to the invention.

The operating table 10 shown in FIG. 1 comprises a base 12, a pillar or column 14 and a patient-support platform 16. The platform is constituted by an assembly of elements articulated with respect to each other and enabling deformation of the surface on which the patient rests.

Each of the table's mobile elements is associated with at least one actuator and a sensor, such as a potentiometer, enabling determination of the position of the actuator, and thereby deduction of the current position of the controlled element in relation to the element in relation to which it is mobile.

For each mobile element, the associated actuator is designated by the same reference number as the element followed by the letter A; the sensor is designated by the same reference number as the element followed by the letter B.

The actuators and sensors are not shown in FIG. 1. They are only shown schematically in FIG. 2. The installation of the sensors and actuators in the operating table is known by the expert in the field.

Figure 3:
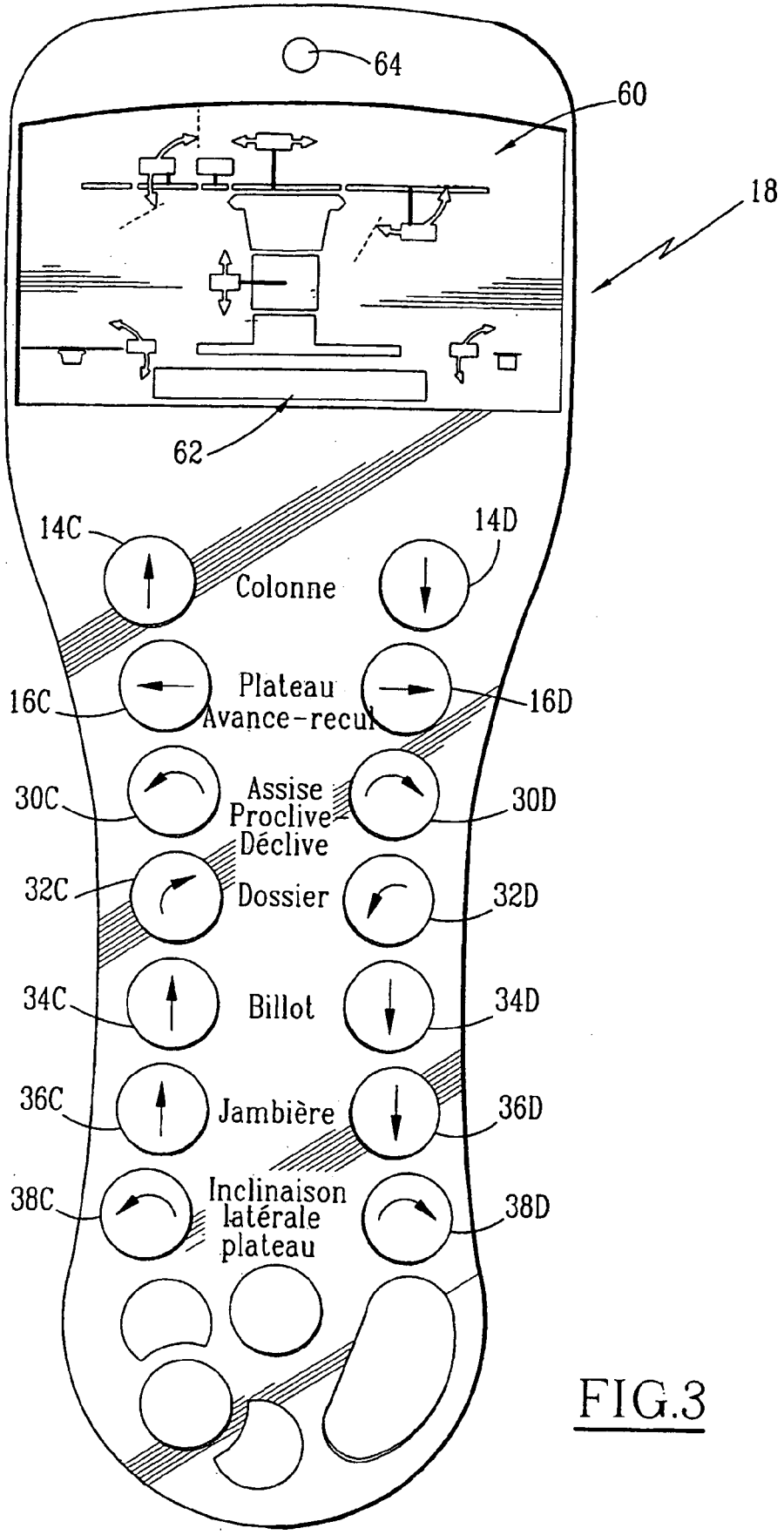
FIG. 3 is an elevation view of a control unit of the table.

Each actuator can be controlled by two specific buttons provided on a table control unit 18 shown by itself on an enlarged scale in FIG. 3.

On this control unit, two control buttons are provided for controlling each actuator in two opposite directions. For each actuator, the two buttons associated with the opposite directions are designated by the same reference number as the controlled element of the table, followed by the letters C and D.

The column 14 can be displaced in relation to the base 12 so as to regulate the height of the patient-support platform 16. For this purpose, it has an actuator 14A installed between the base 12 and the platform 16. This actuator is associated with a position sensor 14B. The actuator is controlled by the buttons 14C and 14D of the control unit 18.

Figure 4:
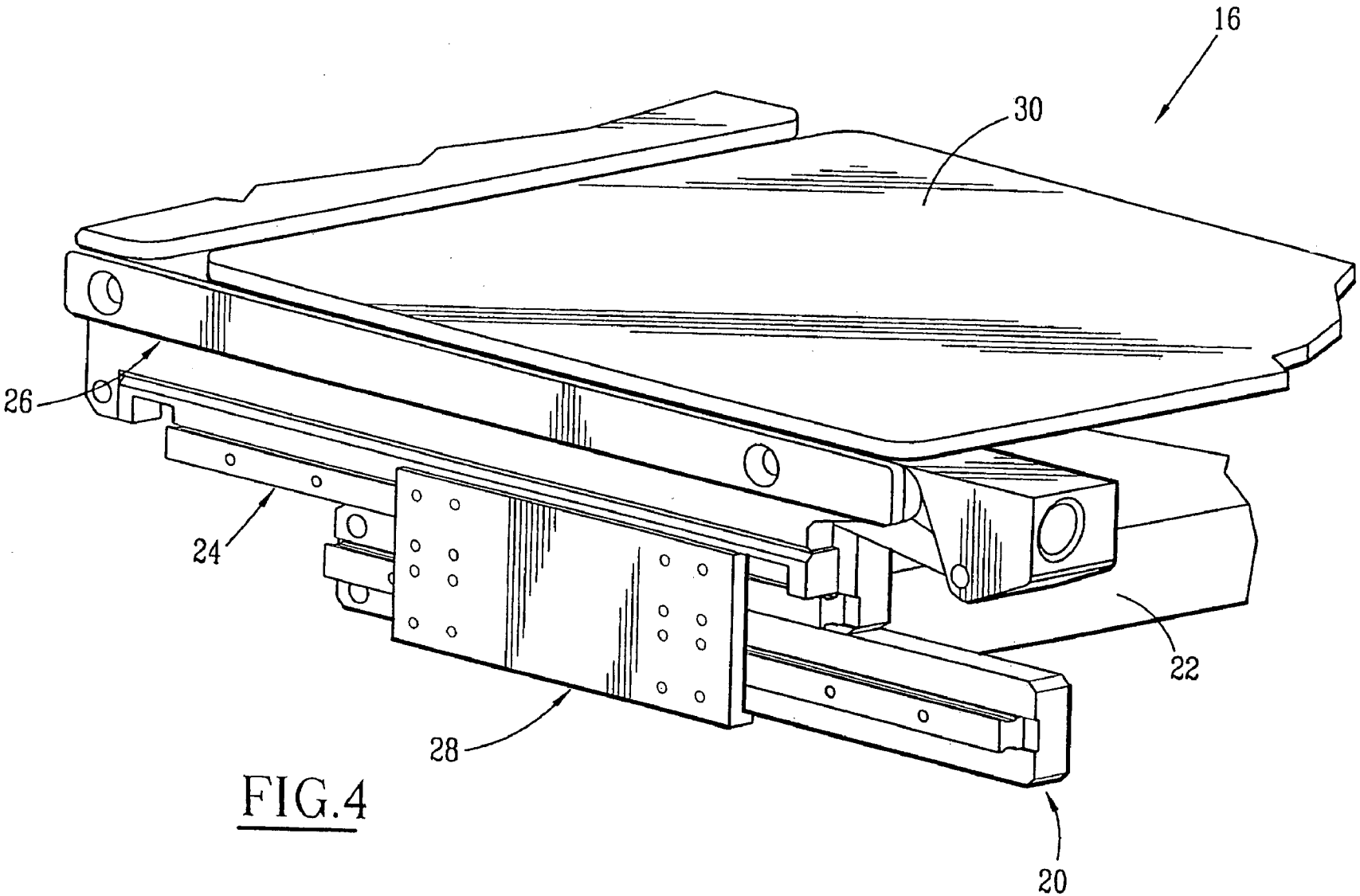
FIG. 4 is a partial perspective view at an enlarged scale of the translational movement guiding device of the table's platform.

The platform assembly 16 is mounted so that it can be displaced in a sliding manner in relation to the column 14 along a direction transverse to the axis of the column. For this purpose, guiding and motorization means for the platform in relation to the top of the column are provided. These means are shown in an enlarged scale in FIG. 4.

They comprise on each side of the platform 16 a first essentially horizontal bottom rail 20 attached to a top end of the column 14 by two cross-pieces 22. They also comprise a second essentially horizontal top rail 24 positioned above the bottom rail 12 and parallel to it. The top rail 24 is integral with a side rail 26 of the platform and can be displaced in translational movement with this side rail in relation to the first fixed bottom rail 20.

For each of the two pairs of rails 20, 24, a carriage 28 is mounted such that it can freely slide horizontally on the fixed bottom rail 20 from one end to the other of this rail. The top rail 24 is mounted on the carriage 28 and can slide horizontally in relation to it.

The operating table 10 is equipped with an actuator identified as 16A for the translational movement of the platform assembly 16 in relation to the column 14. This actuator provides for the translational displacement of each top rail 24 in relation to the associated fixed bottom rail 20.

In the envisaged mode of implementation, the actuator 16A is rotatory. Its body is integral at one end of the fixed bottom rail 20. Its output pinion is connected by a chain to a pinion of a rotatory shaft positioned in the medial part of the rail 20. This shaft extends perpendicularly to the rails 20 and 24. At its other end, the rotatory shaft comprises a pinion meshing a rack extending along the entire length of the rail 24, the rack being carried by the interior surface of the rail 24.

With an arrangement such as described below, the top rail 24 can be displaced from one end to the other of the bottom rail 20 and can, in its extreme positions, extend overhanging the bottom rail 20, thereby enabling a very large amplitude of displacement of the platform 16.

The actuator 16A is equipped with a position sensor 16B and is controlled from two buttons 16C and 16D of the control unit enabling respectively the displacement of the platform toward the patient's head (forward movement) and toward the patient's feet (backward movement) when a patient is lying on the table.

The platform 16 comprises in its center part a baseplate 30 carried by the side rails 26. An actuator 30A is positioned between the baseplate and the top of the column 14 to enable control of the tilting of the platform 16 in relation to the axis of column 14 and around an axis extending generally transversely to the longitudinal axis of the platform 16.

The actuator 30A is associated with a position sensor 30B and is controlled by two buttons 30C and 30D of the control unit 18, these buttons corresponding respectively to a downward tilting of the patients' head (backward sloping) or the opposite, an upward raising of the patient's head (forward sloping).

A backrest 32 is articulated at one end of the baseplate 30. An actuator 32A is positioned between the backrest and the baseplate to enable the angular displacement of the baseplate under the control of two buttons 32C and 32D of the control unit, these buttons being associated respectively with a raising and a lowering of the baseplate.

A position sensor 32B is also associated with the actuator 32A to determine the position of the backrest in relation to the baseplate.

The free end of the backrest is extended by a removable headrest 33.

The baseplate 30 has at its end, in the region of connection to the backrest 32, a mobile support or block 34 that can be displaced between a retracted position in the general plane of the baseplate 30 and a deployed position in which it protrudes from the general plane of the baseplate 30.

The block 34 is intended to act on the patient's lower back to push it out of the way of the backrest 32.

The block 34 is controlled by an actuator 34A positioned between this support and the baseplate 30. This actuator 34A is controlled from two buttons 34C and 34D of the control unit enabling respectively the deployment or retraction of the block 34. The actuator is associated with a position sensor 34B.

A legrest 36 is articulated at the other end of the baseplate 30. It is controlled by an actuator 36A positioned between the legrest 36 and the baseplate 30. This actuator is associated with a position sensor 36B. It can be displaced under the control of the buttons 36C and 36D of the control unit, these buttons being associated respectively with the raising and lowering of the legrest.

Finally, a final actuator is interposed between the platform 16 and the top end of the column 14 to enable lateral tilting to the right and left of the baseplate 16 along its longitudinal axis. Thus, the actuator 38A enables the tilting of the platform assembly. This actuator is indicated as 38A and does not respect the notation convention because it constitutes a second actuator acting on the platform 16.

Whereas the actuator 30A enables a tilting of the baseplate and the platform assembly 16 along a transverse axis of the platform, the actuator 38A enables a lateral tilting of the baseplate and the platform assembly along a longitudinal axis of the platform. The actuator 38A is associated with a position sensor 38B and is controlled by two buttons 38C and 38D of the control unit 18 enabling a lateral tilting respectively to the left and to the right.

Figure 2:
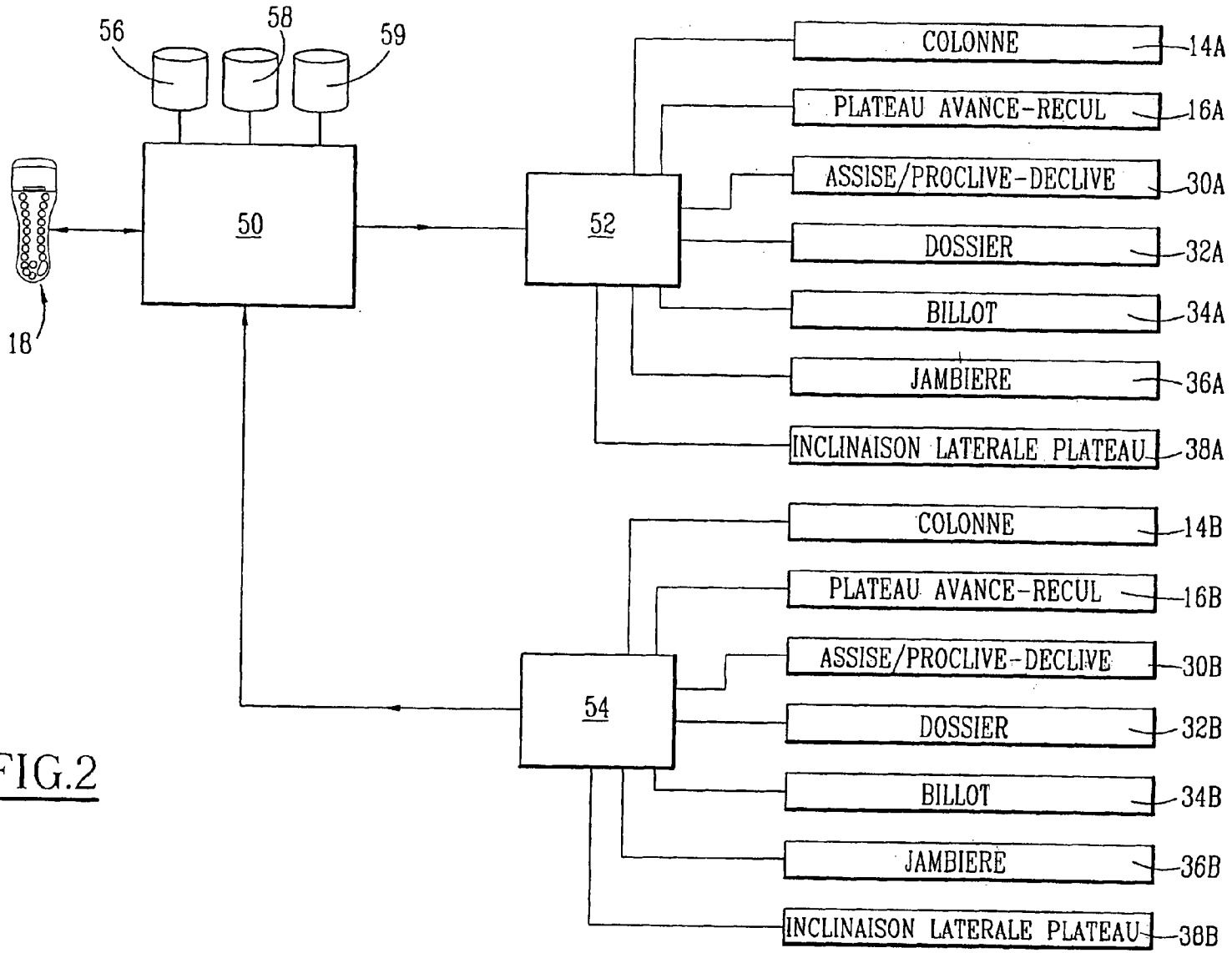
FIG. 2 is a schematic view of the actuation means of the table.

The table's control circuit is illustrated schematically in FIG. 2. It comprises a central data processing unit 50 to which is connected the control unit 18 by a bidirectional data transfer connector.

The central data processing unit 50 is also connected to a command interface 52 to which each of the actuators 14A, 16A, 30A, 32A, 34A, 36A and 38A is connected. The command interface 52 is designed to provide electric current to the actuators as a function of the control data received from the central data processing unit. In particular, the command interface is designed to control in one direction or the other each of the actuators as a function of the data received from the central unit 50 for a duration corresponding to the displacement course desired for the element controlled by the corresponding actuator.

Similarly, the central data processing unit 50 is linked to a read interface 54 to which is connected each of the sensors 14B, 16B, 30B, 32B, 34B, 36B and 38B associated with the actuators. This read interface is designed to continuously receive the current position values of each of the elements of the operating table and to send them to the central data processing unit 50.

The central data processing unit 50 is also connecting to means 56 for storing a set of programs and routines implemented for the functioning of the table as well as means 58 for storing a set of data relative to the structure of the table and its particular control concepts.

The central data processing unit 50 also comprises means 59 for storing operating default messages produced during the functioning of the operating table.

In addition to the previously described control buttons, the control unit 18, represented in an enlarged scale in FIG. 3, comprises a set of control buttons to lock the operation of the table or to shut off the power to the table.

All of the control buttons are advantageously backlit to facilitate their identification and the handling of the control unit.

The control unit 18 has in its top part a display screen 60 on which appears a schematic representation of the table, with each of the table's mobile elements being associated with its own display on which is permanently displayed a value representative of the position of the element in question. The display screen 60 is advantageously backlit for better legibility.

The control unit furthermore comprises, according to the invention, means 62 making available to the user a corrective command order to stop a situation in which there exists a risk of collision of an element during a particular command applied to the operating table.

The means 62 making available the corrective command order comprise, for example, a screen allowing the display of a line of text indicating, especially, the element to be displaced and the direction of displacement of the element so as to stop the potential collision situation.

The control unit 18 furthermore has an alarm 64 such as a warning light and/or sound emission transducer to alert the user when a collision issue occurs and that the displacement request being executed is stopped.

The data displayed on the display device 60 and in particular on the screen 62 stem from the central data processing unit 50. The values presented on the individual displays associated with each of the table's mobile element are sent by the central data processing unit 50 collecting these data from the read interface 54 to which each of the sensors is linked.

Figure 5:
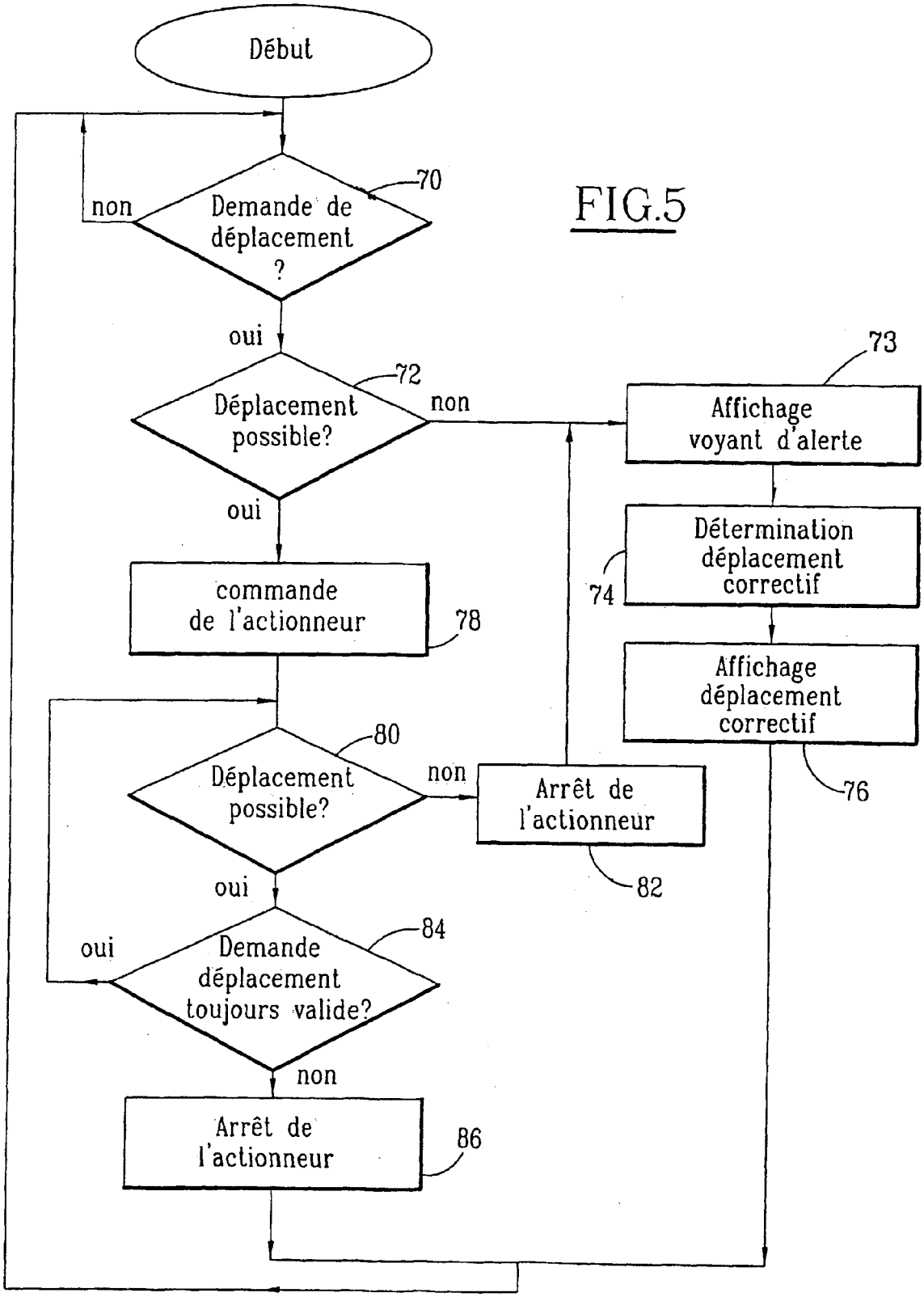
FIG. 5 is a flow chart explaining an operating routine of the table.

The message displayed on the screen 62 is sent by the central data processing unit 50 upon implementation of the routine the algorithm of which is illustrated in FIG. 5.

At rest, the central data processing unit 50 awaits in step 70 the receipt of a displacement request. For this purpose, it monitors the set of buttons of the control unit 18. Step 70 remains continuously in effect until a button is pressed.

When a button is pressed, the routine ascertains in step 70 whether the requested displacement is possible without there being a risk of collision for one of the table's mobile elements. For this purpose, the position of the element whose displacement is requested is compared to a limit value.

According to a first mode of implementation of the invention, the limit values for each actuator are stored in memory in the storage means 58.

According to a second mode of implementation of the invention, the limit values for each actuator are calculated as a function of the positions of the table's other mobile elements. The limit values are calculated from laws stored in memory in the storage means 58. Examples of such laws are presented in the description below. These laws are designed to enable determination of whether the displacement requested by the user is possible without it resulting in a collision either between two of the table's elements or between one of the table's elements and an environmental obstacle such as the floor.

Such a law can take the form of an inequation that must be ascertained by the current position value of the mobile element in question, this inequation being dependant on parameters formed by current position values of the other mobile elements.

If the displacement is not possible in step 72 because the measured position value does not satisfy the criteria allowing the displacement, the warning light 64 is lit in step 73 to warn the user that the requested displacement cannot be executed. Thus, no actuator commands are implemented.

Step 74 is then implemented during which the central data processing unit 50 determines a corrective command order for another element of the table so as to make it possible—after displacement of this other element of the table—for the displacement initially requested by the user to be implemented without risk of collision.

This corrective command order is collected in the storage means 58 as a function of the initial displacement request formulated by the user.

Examples of such corrective command orders are presented in the description below. The function of these corrective command orders is to stop the risk of collision upon the implementation of the displacement initially requested by the user. Thus, these corrective command orders have the purpose of modifying the table's configuration to stop the impossible situation resulting from the nonsatisfaction of the criteria during the test performed in step 72.

The corrective displacement order determined in step 74 is made available to the user in step 76 by being displayed on the screen 62.

The corrective order made available to the user comprises an identification of the actuator to be activated or the element of the table to be displaced as well as identification of its direction of displacement.

In other words, the message displaced on the screen 62 allows the user to determine which button of the control unit 18 he should press to stop the risk of collision detected in the case of movement of the table according to his initial displacement request.

At the end of step 76, the test performed in step 70 is implemented again to enable the user to implement another table displacement request from the control unit 18.

In particular, the user is encouraged to take into account the corrective command order displayed on the screen 62 and to implement this command order by pushing on the corresponding button to displace the designated element in the direction indicated in the corrective order.

After implementation of the corrective order, the displacement initially requested by the user can be executed.

If, in step 72, the requested displacement is judged to be possible by the data processing unit 50, the corresponding actuator is driven in step 78 from the interface 52. Upon displacement of the actuator, the test executed in step 80 is implemented in a loop to ascertain whether the displacement is still possible without risk of collision for the various table elements.

As soon as a risk of collision is detected, the actuator is commanded to stop in step 82 and steps 73 to 76 are implemented again. In particular, a corrective command order is displayed on the screen 62 to provide the user with an indication of a new table displacement request which—after implementation—should enable implementation of the initially requested displacements.

When the displacement is possible, the test executed in step 84 ascertains whether the displacement request is still valid, i.e., whether the user still pushes the button corresponding to the control of an actuator. As long as the request is still valid, steps 80 to 84 are implemented in the loop.

When the displacement request is no longer valid, i.e., when the user releases the control button that he was pushing down on, the stopping of the actuator is commanded in step 86, after which the test executed in step 70 is again implemented in the loop until a new table displacement request.

It can be understood that with the implementation of such a routine, the user is not confused when, upon a request for displacement by pushing on a button, no movement of the table takes place, or when this movement is only executed temporarily and is interrupted even though the user has not released the corresponding control button.

When such a stopping of the actuator or a refusal to trigger the actuator occurs because of the detection of a risk of collision of one of the table's elements, the user is immediately so informed by an alarm and a corrective command order is made available by being displayed on the screen 62, this corrective order being such that when it has been implemented, the initially demanded displacement request can be implemented.

In the table below are presented examples of corrective command orders with the indication of displacement requests made impossible and the indication of the message provided to the user.

In the table below the first column indicates the command for which a risk of collision can be produced. The button number on the control unit 18 providing for this displacement is indicated in parentheses.

The second column indicates the figure on which is illustrated the operating table in a position in which a collision can be produced during the implementation of the command indicated in the first column.

The third column lists the elements that could be involved in a collision with each other.

The fourth, fifth and sixth columns each indicate an elementary condition that could cause a collision, these conditions pertaining to the current position values of each of the actuators provided by the sensors placed on the operating tables.

Depending on the case, when the two or three conditions are ascertained, then the stopping of the actuator in movement is triggered and a message appears on the screen to indicate to the user a corrective command order to be implemented.

Thus, the movement space of the operating table is cut into distinct situations by the conditions.

The seventh column contains the corrective command order made available to the user by being displayed on the screen 62. The button number on the control unit that must be pressed to apply this corrective command order is shown in parentheses.

The eighth column indicates the default operating message recorded in the storage means 59 upon detection of a risk of collision or a collision.

The following variables are used in the table below:

h=vertical displacement of the column, t=translational movement of the platform, d°=angle of the legrest, b°=angle of the backrest, l°=angle of lateral tilt, k=height of the block.

F1 to F6 are geometric and arithmetic functions dependent on the kinematic of the operating table.

C1 to C6 are constants characteristic of the geometry of the operating table and act as a base for the comparisons.

| | Commands | Figure | Possible collision | (If) Condition 1 | (&If) Condition 2 | (&IF) Condition 3 | (Then) ALS & Display | Error code |
|---|---|---|---|---|---|---|---|---|
| 1 | lower | 6E | leg plate/base | p° < 0° | F1(d°, t, p°) > C1 | F2(h, d°, t, p°, l°) < C2 | raise legrest (36C) | legrest/base |
| 2 | column (14D) | 6D | leg plate/floor | p° < 0° | F1(d°, t, p°) < C1 | F3(h, d°, t, p°, l°) < C3 | raise legrest (36C) | legrest/floor |
| 3 | | 6C | headrest/floor | b° < 0° | d° < 0° | F4(t, d°, b°, l°, h) < C4 | forward slope (30D) | headrest/floor |
| 4 | head | 6B | leg plate/translation | p° < 0° | t < 0 | F6(t, p°) < C6 | raise legrest (36C) | legrest/slide |
| 5 | translational | 6E | leg plate/base | p° < 0° | F1(d°, t, p°) > C1 | F2(h, d°, t, p°, l°) < C2 | raise legrest (36C) | legrest/base |
| 6 | movement (16C) | 6F | leg plate/column | p° < 0° | d° > 0° | F5(d°, t, p°) > C5 | raise legrest (36C) | legrest/column |
| 7 | feet | 6A | backrest/translation | b° < 0° | t > 0 | | raise backrest (32C) | backrest/slide |
| 8 | translational | 6E | leg plate/base | p° < 0° | F1(d°, t, p°) > C1 | F2(h, d°, t, p°, l°) < C2 | backward slope (30C) | legrest/base |
| 9 | movement (16D) | 6D | leg plate/floor | p° < 0° | F1(d°, t, p°) < C1 | F3(h, d°, t, p°, l°) < C3 | backward slope (30C) | legrest/floor |
| 10 | lower | 6E | leg plate/base | p° < 0° | F1(d°, t, p°) > C2 | F2(h, d°, t, p°, l°) < C2 | raise column (14C) | legrest/base |
| 11 | legrest (36D) | 6D | leg plate/floor | p° < 0° | F1(d°, t, p°) < C1 | F3(h, d°, t, p°, l°) < C3 | raise column (14C) | legrest/floor |
| 12 | | 6B | leg plate/translation | p° < 0° | t < 0 | F6(t, p°) < C6 | plate toward feet (16D) | legrest/slide |
| 13 | | 6F | leg plate/column | p° < 0° | d° > 0° | F5(d°, t, p°, l°) > C5 | plate toward feet (16D) | legrest/column |
| 14 | raise backrest (32C) | 6G | block/backrest | b° < 0° | k > 0 | | retract block (34D) | block/backrest |
| 15 | lower | 6C | headrest/floor | b° < 0° | d° < 0° | F4(t, d°, b°, l°, h) > C4 | raise column (14C) | headrest/floor |
| 16 | backrest (32D) | 6A | backrest/translation | b° < 0° | t > 0 | | plate toward feet (16D) | backrest/slide |
| 17 | raise block (34C) | 6G | block/backrest | b° < 0° | k > 0 | | lower backrest (32D) | block/backrest |
| 18 | backward slope (30C) | 6C | headrest/floor | b° < 0° | d° < 0° | F4(t, d°, b°, l°, h) > C4 | raise column (14C) | headrest/floor |
| 19 | forward | 6D | leg plate/floor | p° < 0° | F1(d°, t, p°) < C1 | F3(h, d°, t, p°, l°) < C3 | raise column (14C) | legrest/floor |
| 20 | slope (30D) | 6E | leg plate/base | p° < 0° | F1(d°, t, p°) > C1 | F2(h, d°, t, p°, l°) < C2 | raise column (14C) | legrest/base |
| 21 | | 6F | leg plate/column | p° < 0° | d° > 0° | F5(d°, t, p°, l°) > C5 | plate toward feet (16D) | legrest/column |
| 22 | lateral tilt | 6D | leg plate/floor | p° < 0° | F1(d°, t, p°) < C1 | F3(h, d°, t, p°, l°) < C3 | raise column (14C) | legrest/floor |
| 23 | (38C or 38D) | 6E | leg plate/base | p° < 0° | F1(d°, t, p°) > C1 | F2(h, d°, t, p°, l°) < C2 | raise column (14C) | legrest/base |
| 24 | | 6F | leg plate/column | p° < 0° | d° > 0° | F5(d°, t, p°, l°) > C5 | raise legrest (36C) | legrest/column |
| 25 | | 6C | headrest/floor | p° < 0° | d° < 0° | F4(t, d°, b°, l°, h) > C4 | raise column (14C) | headrest/floor |

Figure 6A:
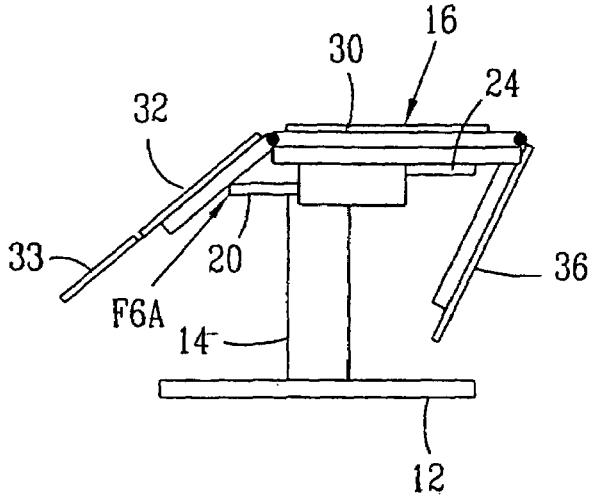
FIGS. 6A, 6B, 6C, 6D, 6E, 6F and 6G are schematic elevation views of the table illustrating cases of collision of the table's mobile elements with each other or of one of the table's mobile elements with the floor.

In the first case, illustrated in FIG. 6A, the table's platform 16 is moved toward the patient's feet to a considerable degree. In this case, the lowering of the backrest 32, by action on the button 32D, is limited or blocked because of the risk that the rear surface of the backrest 32 could hit the end of the rail 20 as shown by the arrow F6A.

Upon stopping the lowering of the backrest, as soon as the conditions indicated in the sixteenth line of the table are satisfied, the corrective command order "displacement of platform toward the head" is displayed on the screen 62. This order causes the user of the table to displace the platform by pushing on the button 16C to move the backrest away from the rail 20 and thereby subsequently enable a greater lowering of the backrest.

In the following case also illustrated in FIG. 6A, it is assumed that the platform is not completely displaced toward the feet and the backrest is already folded downward to a considerable degree. The command to displace the platform toward the feet causes a risk of the backrest 32 hitting the end of the rail 20. The displacement of the platform toward the feet is interrupted when the conditions indicated in the seventh line of the table are satisfied. Upon the refusal to satisfy the displacement request from the user attempting to further displace the platform toward the feet, the message "raise backrest" appears on the screen 62.

Figure 6B:
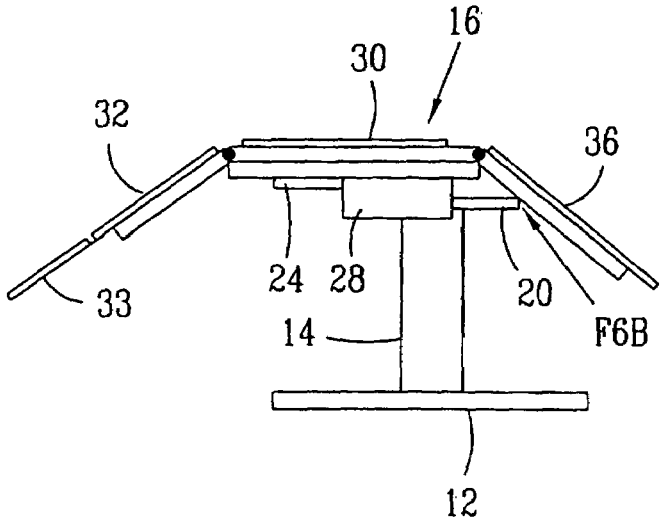

In the case in which the platform 16 is displaced toward the patient's head to a considerable degree, as shown in FIG. 6B, the displacement request attempting to lower the legrest 36 is not satisfied until the conditions indicated in the twelfth line of the table are ascertained. As indicated by the arrow F6B, there is a risk of collision between the legrest 36 and the bottom rail 20. When this condition is ascertained, the downward movement of the legrest 36 is blocked and the message "displacement of platform toward the feet" appears on the screen 62.

Similarly, as illustrated in FIG. 6B, when the legrest 36 is lowered to a considerable degree, the request for displacement of the platform 16 intended to move it toward the head is blocked or interrupted when the conditions indicated in the fourth line of the table are satisfied because there is a risk of collision between the legrest 36 and the bottom rail 20. Upon stopping the displacement of the platform 16, the message "raise legrest" is displayed.

Figure 6C:
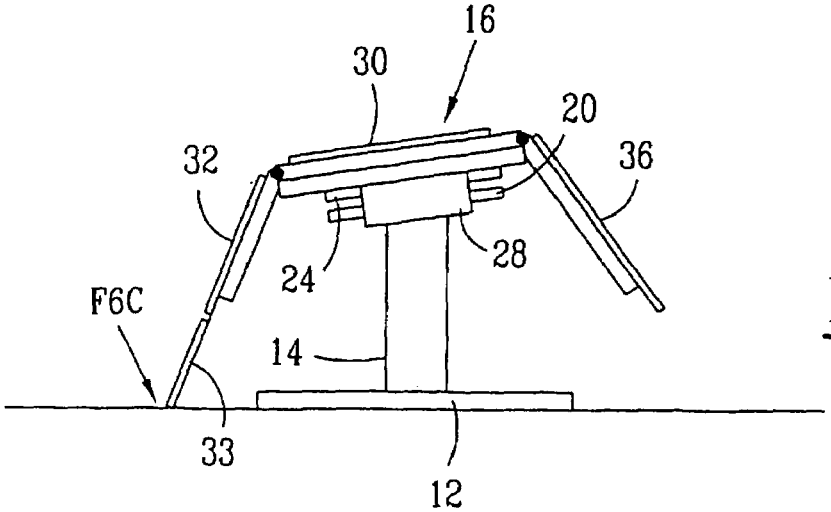

When the platform 16 is tilted toward the side of the patient's head to a considerable degree as shown in FIG. 6C, the request for descending the backrest 32 is blocked or interrupted to prevent its end fitted with the headrest 33 from hitting the floor as indicated by the arrow F6C. When the conditions indicated in the fifteenth line of the table are satisfied, the downward displacement of the backrest 32 is blocked and the message "tilt platform toward feet" is displayed.

Other conditions of possible collisions between the headrest and the floor, as illustrated in FIG. 6C, are presented in table 1 on lines 3, 18 and 25.

Figure 6D:
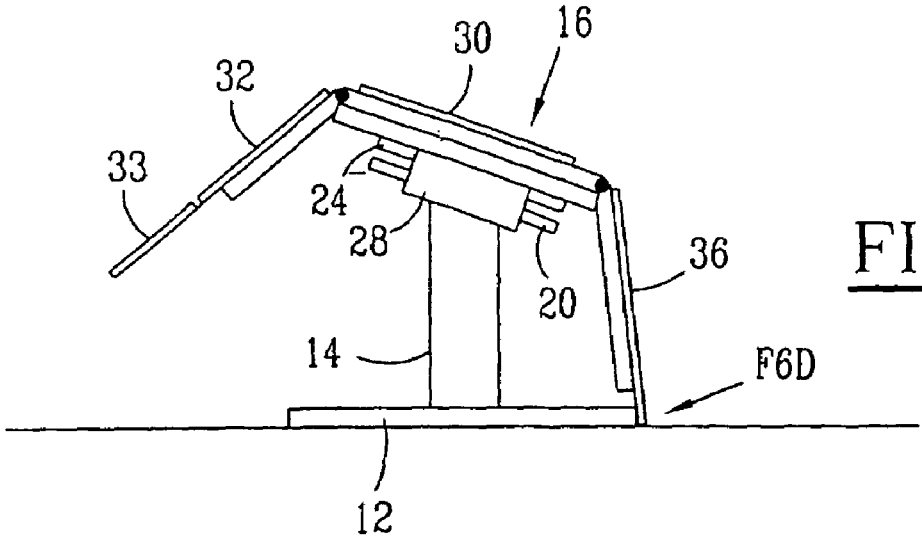

As illustrated in FIG. 6D, when the platform 16 is tilted toward the feet to a considerable degree, the downward tilting of the legrest 36 is blocked when the conditions indicated on the eleventh line of the table are ascertained and the message "raise column" is displayed because there is a risk of the end of the legrest 36 hitting the floor as indicated by the arrow F6D.

In the same situation illustrated in FIG. 6D, when the legrest 36 is folded downward to a considerable degree, the further frontward tilting of the platform toward the feet (forward sloping) is blocked so as to prevent the legrest from hitting the floor as indicated by the arrow F6D. This blocking is implemented when the conditions indicated in the nineteenth line of the table are ascertained and the message "raise column" is displayed.

The cases of possible collisions such as are illustrated in FIG. 6D are specified in the second, ninth and twenty-second lines of the table. The displayed message is shown in the seventh column for each case.

Figure 6E:
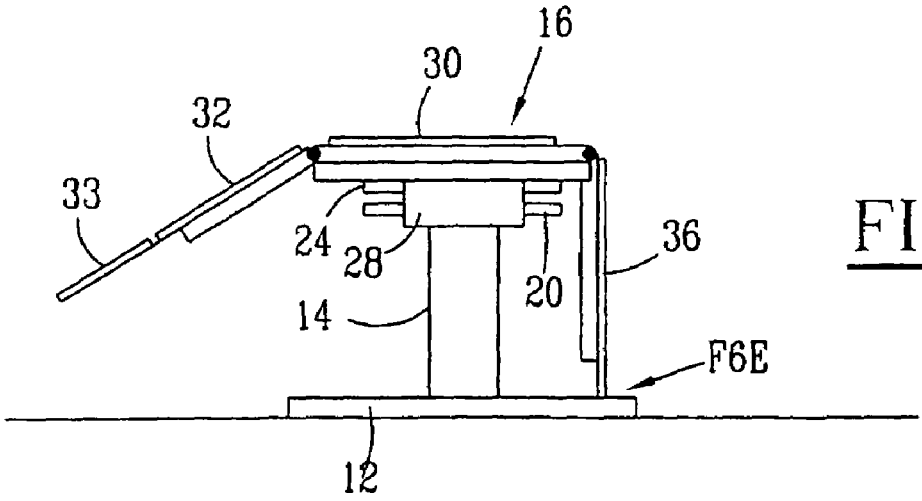

When the legrest 36 is folded downward as illustrated in FIG. 6E, the request intending to reduce the height of the column 14 is interrupted when the conditions indicated in the first column of the table are satisfied and the message "raise legrest" is displayed because, as illustrated by the arrow F6E, there is a risk that the end of the legrest could hit the floor.

Similarly, in the same situation illustrated in FIG. 6E, when the table's platform 16 is already at a relatively low level, the downward displacement of the legrest 36 is limited when the conditions indicated in the tenth line of the table are ascertained to prevent the end of the legrest from hitting the floor. When the request for displacement of the legrest cannot be satisfied, the message "raise the column" is displayed.

Other cases of potential collisions and the messages then displayed on the screen in a case corresponding to that FIG. 6E are specified in the table on the fifth, eighth, twentieth and twenty-third lines.

Figure 6F:
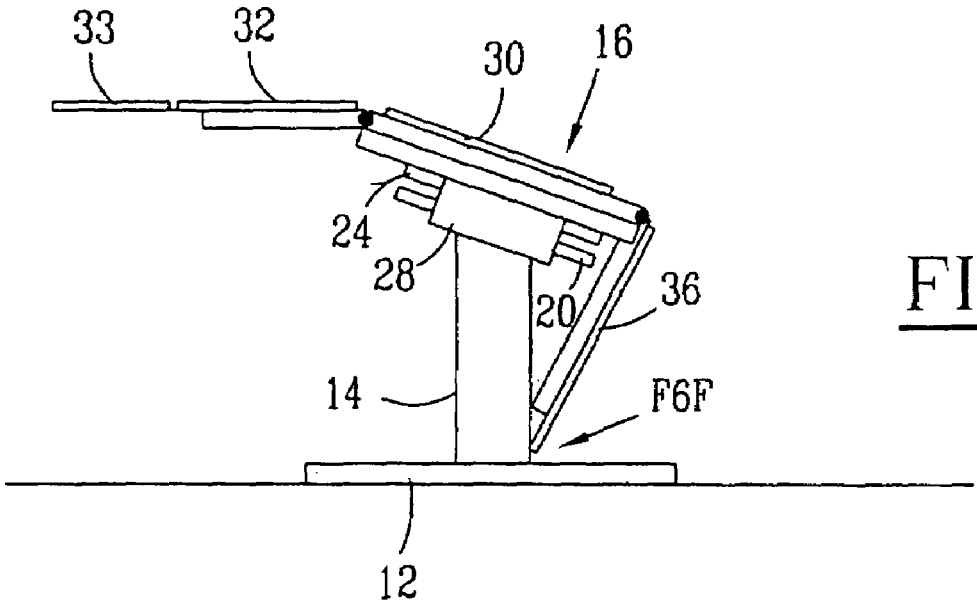

As illustrated in FIG. 6F, when the legrest 36 is folded to a considerable degree there is a risk that it could hit the column 14 as shown by the arrow F6F.

Thus, as shown in the sixth line of the table, upon a request for the translational movement of the platform toward the head, the command is interrupted when the conditions indicated in the sixth line are ascertained. The message "raise legrest" is then displayed.

Other conditions of potential collisions between the end of the legrest and the column are specified in the third, twenty-first and twenty-fourth lines of the table.

Figure 6G:
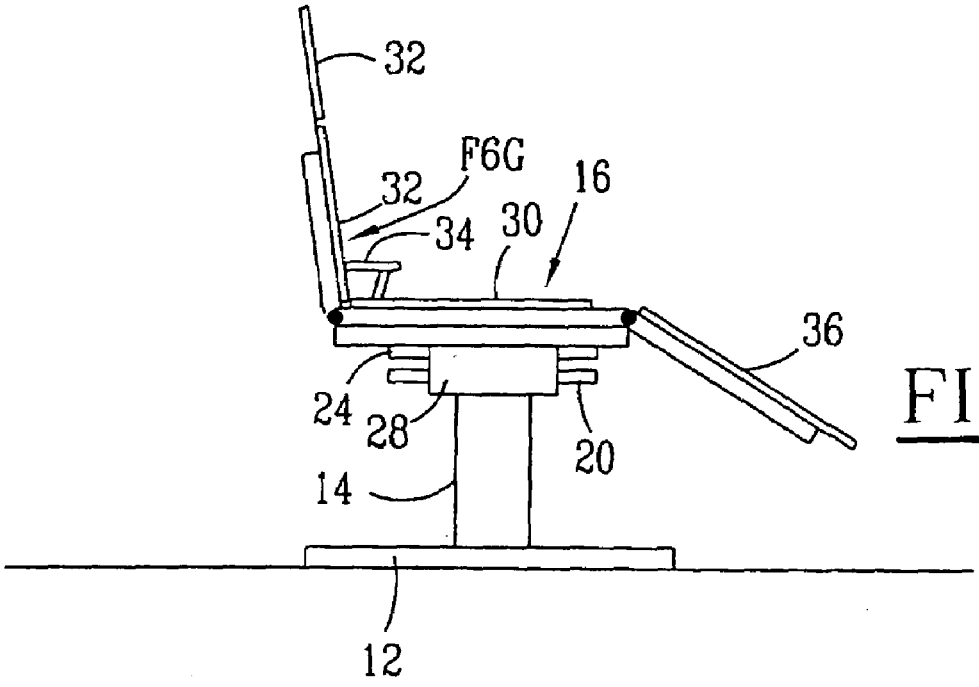

Finally, as illustrated in FIG. 6G, when the block 34 protrudes in relation to the baseplate 30, the command "raise backrest" must be limited so as to prevent a collision between the backrest and the block as indicated by the arrow F6G.

Thus, as indicated in the fourteenth line of the table, when the conditions indicated in this line are ascertained, the raising of the backrest is interrupted and the message "lower block" is displayed.

The cases of potential collision and the solutions provided appearing in the table above are only examples and other cases of collision are also handled by implementation of the routine presented in FIG. 5.

Moreover, the central data processing unit 50 is designed to determine the collision of each of the table's mobile elements during its movement with an object positioned on the trajectory of the mobile element.

For this purpose, upon displacement of one of the table's mobile elements, the central data processing unit monitors the evolution of the value provided by the sensor associated with the actuator acting on the mobile element. If an object positioned on the trajectory of the mobile element causes the stopping of the actuator—even momentarily—the central data processing unit detects this stopping due to the fact of the lack of temporal evolution of the value provided by the sensor associated with the actuator. The actuator command is immediately interrupted and a message "abnormal stop" is sent to the user by display on the screen 62.

The user informed in this manner can then ascertain whether in fact an object hinders the displacement of the mobile element.

The invention claimed is:

1. An operating table comprising:

at least three elements which are moveable in relation to each other;

at least two actuators, each controlling displacement of two elements in relation to the other;

means for driving each actuator;

means for detecting a risk of collision of one of the elements with an obstacle when executing a displacement request of a first actuator;

means for determining a corrective command order of a second actuator different from the first actuator upon detecting a risk of collision, wherein execution of the corrective command order by the second actuator causes cessation of the detected risk of collision upon subsequent execution of the displacement request of the first actuator; and means to make available to a user the corrective command order.

2. The table according to claim 1, wherein the means making available the corrective command order comprises means for displaying the actuator to be commanded and direction of the actuator command.

3. The table according to claim 1 or 2, further comprising means to stop the first actuator upon detection of a risk of collision of a mobile element of the operating table with an obstacle.

4. The table according to claim 1, wherein the means for detecting a risk of collision of a mobile element of the operating table with an obstacle comprise means for determining current position values of the elements of the table.

5. The table according to claim 4, wherein the detection means comprises means for comparing the current position values of the elements of the table with predetermined limit values.

6. The table according to claim 5, wherein the detection means comprises means for storing the predetermined limit values.

7. The table according to claim 5, wherein the detection means comprises means for calculating predetermined limit values as a function of the current position values of other elements of the table.

8. The table according to claim 1, further comprising means for detecting an involuntary stopping of a mobile element in displacement.

9. An operating table comprising:

at least three elements which are moveable in relation to each other;

at least two actuators, each controlling displacement of two elements in relation to the other;

a controller which drives each actuator;

a sensor to detect a risk of collision of one of the elements with an obstacle when executing a displacement request of a first actuator;

a controller which determines a corrective command order of a second actuator different from the first actuator upon detecting a risk of collision, wherein execution of the corrective command order by the second actuator causes cessation of the detected risk of collision upon subsequent execution of the displacement request of the first actuator; and a display to view the corrective command order.

* * * * *